United States Patent [19]

Mendenhall

[11] 4,265,546

[45] May 5, 1981

[54] ASPHALT-AGGREGATE DRUM MIXING APPARATUS

[76] Inventor: Robert L. Mendenhall, 1770 Industrial Rd., Los Vegas, Nev. 89102

[21] Appl. No.: 155,502

[22] Filed: Jun. 2, 1980

Related U.S. Application Data

[60] Division of Ser. No. 1,051, Jan. 8, 1979, Pat. No. 4,219,278, and a continuation-in-part of Ser. No. 871,351, Jan. 23, 1978, Pat. No. 4,208,131, and a continuation-in-part of Ser. No. 906,734, May 17, 1978.

[51] Int. Cl.[3] ..... B28C 5/46

[52] U.S. Cl. ..... 366/7; 366/25

[58] Field of Search ..... 366/4, 25, 22, 23, 24, 366/3, 144, 147, 183, 42, 54, 148, 145, 149, 54, 7

[56] References Cited

U.S. PATENT DOCUMENTS

| | | | |
|---|---|---|---|
| 960,410 | 6/1910 | Ryan | 366/25 |
| 1,578,021 | 3/1926 | Elze | 366/25 |
| 4,075,710 | 2/1972 | Jakob | 366/25 |
| 4,089,508 | 5/1978 | Anderson | 366/25 |

*Primary Examiner*—Robert W. Jenkins

*Attorney, Agent, or Firm*—Seiler & Quirk

[57] ABSTRACT

An improved apparatus for recycling asphaltic concrete includes an inclined chute for introducing composition into an open port into which a burner also feeds hot gases of combustion. The apparatus provides for improved continuous processing by feeding composition containing relatively large particle sizes into the open port and recovering heated composition adjacent the opposite drum end.

3 Claims, 3 Drawing Figures

ASPHALT-AGGREGATE DRUM MIXING APPARATUS

This is a division of application Ser. No. 001,051, filed Jan. 8, 1979, now U.S. Pat. No. 4,219,278 and a continuation-in-part of co-pending applications Ser. No. 871,351, filed Jan. 23, 1978, now U.S. Pat. No. 4,208,131 and Ser. No. 906,734, filed May 17, 1978.

BACKGROUND OF THE INVENTION

In my aforesaid co-pending applications, there are disclosed apparatus and methods for treating asphalt-aggregate compositions, particularly rotatable drum apparatus having an enlarged port open to atmosphere into which flame and hot gases of combustion are directed by a burner, and out of which simultaneously exhaust gases from the flame and combusted asphalt hydrocarbon volatiles, are vented. In that apparatus, composition to be heated and mixed may be introduced through the open port. Although the apparatus may also be provided with additional means for introducing compositions at or near the opposite end of the drum from the open port, such additional means are normally useful only for composition which is crushed, and of relatively small particle sizes. Thus, where larger particle sizes, chunks or pieces of asphaltic concrete are to be introduced into the drum, this must normally be accomplished through the open drum port.

Particularly, when the apparatus is moved to a job site at which asphaltic concrete is to be recycled, the composition is often not crushed and screened, but instead, is made up of both relatively small particles, and larger particles, chunks, and pieces. Thus, the material to be introduced into the drum and treated, is made up of a substatantial range of particle sizes. Usually, it is most convenient to simply shovel the materials into the large open port of the drum. Although such a method of feeding the material appears to be relatively simple, once the operation is begun, and the burner is ignited in front of the open port, the shoveling of the material into the port may be hampered. Particularly where the composition includes rather large chunks which must be shoveled into the open port past the ignited burner, an operator may be fearful of becoming burned, since shoveling material into the space between the burner and the lip of the port may seem awkward, difficult, or dangerous. It is to the elimination of this problem that the modification of the apparatus according to the present invention is directed.

SUMMARY OF THE INVENTION

The present invention is directed to an apparatus of the drum-type as described in my aforesaid copending applications, modified by the addition of a chute member secured adjacent the open drum port, for assisting in directing composition therein. The chute may comprise an inclined plate, preferably situated relative to the port and burner, so as not to interfere with operation of the latter. The chute is readily accessible for ease of an operator in shoveling composition onto the plate, by which it falls gravitationally into the drum port. The advantages of the invention are particularly of benefit for such hand feeding apparatus having a drum diameter of about 2½ to four feet, a drum length of about 4 to 6 feet, and a capacity of heating and mixing asphaltic concrete at a rate of about 3 to 10 tons per hours. The specific advantages and features of the invention will be fully explained hereinafter.

DETAILED DESCRIPTION OF THE INVENTION

Figure 1:
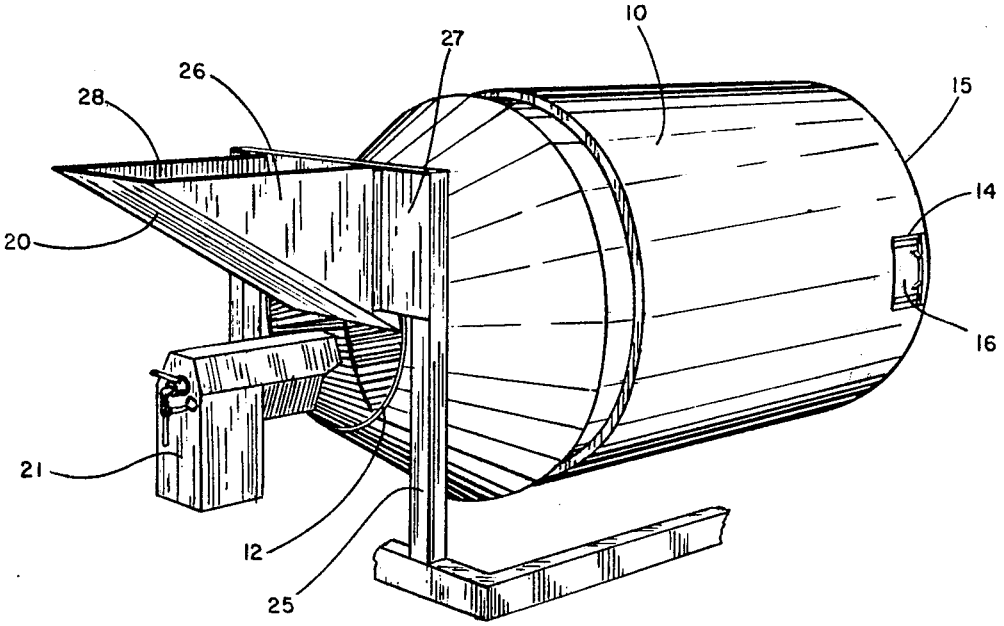
FIG. 1 is a perspective view illustrating the apparatus of the invention.

The drawings illustrate the improved apparatus of the invention comprising the chute member 20 secured adjacent open port 12 on the forward end of drum 10. The description of the rotatable drum apparatus is fully disclosed in my aforesaid co-pending applications, and is incorporated herein by reference. The essential features of the apparatus include the rotatable drum 10, and means for rotating the drum, not shown, normally an engine and drive means for rotating the drum about an axis extending along the drum length, and through the center of the open port 12. A burner 22 is secured adjacent port 12 and, when ignited, directs flame and hot gases of combustion into the drum through the open port. As the drum rotates, the composition particles are exposed to the hot gases of combustion in the drum interior thereby becoming heated and mixed. Further and complete description of such a process is also disclosed in my aforesaid co-pending applications and incorporated herein by reference. In addition, during the heating and mixing process, make-up asphalt, softening agents, or mixtures thereof may also be introduced into the material being treated within the drum. Such additives, and a most convenient process for adding them, are disclosed in my co-pending application Ser. No. 973,747, filed Dec. 26, 1978, (#19) which description is also incorporated herein by reference.

In addition to open port 12 at the forward drum end, is a port 14 at or adjacent the opposite drum end, having a cover 16 for allowing the port to be selectively opened and closed. With such an additional port, composition may be recovered through either port 14 or port 12. However, it has been found most suitable to introduce composition into the open port 12, heating it as it passes along the rotating drum interior toward the opposite drum end 15, and recovering it through port 14. Moreover, except for port 14 adjacent drum end 15 and which is closed except during product recovery, that end of the drum is closed to atmosphere. Although a hopper device may be installed at a drum end 15 as disclosed is my aforesaid application Ser. No. 906,734, such a hopper has closure means at the bottom to prevent a draft of gases within the drum to or from that drum end. However, even when the apparatus is equipped with such a hopper, it will not be used concurrently with the chute of the present invention for feeding composition into the drum. Moreover, according to the present invention, such a hopper is entirely optional and may be eliminated. In that case, an end plate is used having no openings whatever or other means for introducing composition at end 15 of the drum apparatus thereby closing off that drum end, opposite open port 12, except for product recovery port 14, as previously explained.

Figure 2:
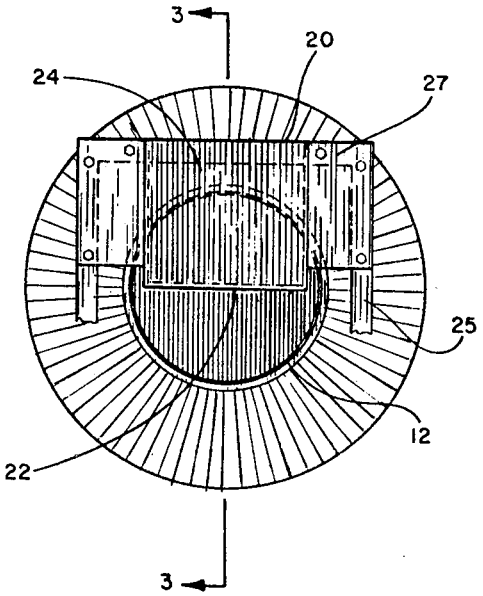
FIG. 2 is a front elevational view of the apparatus as shown in FIG. 1.
Figure 3:
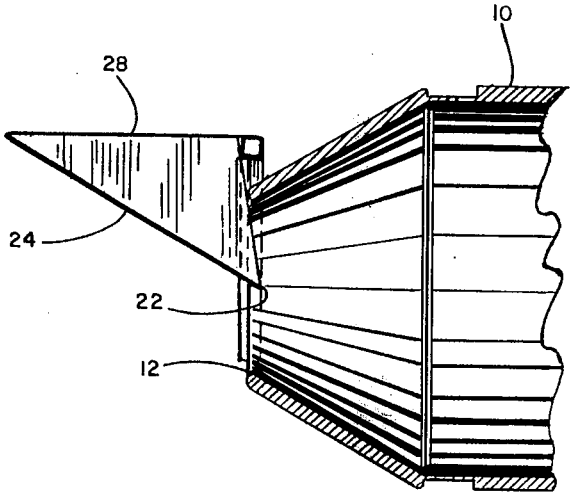
FIG. 3 is a partial side sectional view taken along line 3—3 of FIG. 2.

Chute 20 may comprise any suitable means for being secured adjacent open port 12 onto which composition may be directed and move gravitationally through the port into the drum. Preferably, such a device comprises a plate 24 which is slanted or inclined, and which plate is secured by means such as support arms 25 and brackets 27 which may be welded, bolted, or otherwise secured to the chute and the frame of the drum apparatus. The chute may be movable relative to the securing means so that it can be slanted at different angles, and the bracket and support arms may also be movable relative to the frame whereby the plate can be moved closer to or away from the port. Such movable features are optional. Preferably, the chute will be positioned relative to drum port 12 so that lower edge 22 of the plate extends across port 12 at approximately the center of the port. This feature is more clearly seen in FIGS. 2 and 3 in which lower edge 22 of plate 24 is positioned at approximately the mid point or center of round port 12 opening. So positioned, the plate allows for the bottom half of the port to be open whereby hot gases of combustion from burner 21 can be directed through that port half into the drum 10. The chute is also positioned relative to port 12 so that composition being drawn gravitationally along plate 24 will naturally fall past the lip or opening of the drum port into the drum. As shown in FIG. 3, lower plate edge 22 actually extends slightly past into the drum port. As for the slant of the plate 24, it may be tilted as desired for conveniently being accessible to an operator for shoveling the composition thereon, and so that the tilt is sufficient for rapid gravitational feed to the drum. A pair of side shields 26 and 28 are also preferably secured on plate 24 as part of the chute to assist in directing the composition into the drum and for allowing an operator to more easily shovel material therein. The plate is of a sufficient width and height to provide an adequate chute size for receiving composition, the plate width preferably terminating within the port opening dimensions, so that there will be no spillover past the port opening.

In operating the apparatus of the invention, as previously noted, the chute allows an operator to much more easily introduce composition into the drum as compared to the composition feed embodiments disclosed in my aforesaid co-pending applications. With the burner located in front of the port, and ignited during operation, without the chute, the operator must introduce the composition by normally throwing shovelfulls of it, past the burner into the port. In order to do this, the operator must be selective in properly positioning himself to pick up a shovelfull of composition, and then direct it past the burner into the port. However, with the chute of the invention, the operator can simply shovel the material onto the chute from any position, and need not be concerned with any potential danger caused by the burner and hot gases therefrom. Thus, the chute substantially increases the ease in which the appratus is used and loaded by hand.

The further advantages of using the apparatus incorporating the chute modification of the present invention is especially advantageous in a continuous operation. In batch processing, the drum is simply filled, and the composition is heated and mixed as the drum is rotated, with port 14 being closed by port cover 16. When the desired composition temperature has been reached, rear port 14 is opened and composition recovered therefrom. Alternatively, composition can also be recovered through forward open port 12, but this requires that the drum be tilted somewhat. However, continuous processing is normally preferred, unless the jobsite requires only relatively small amounts of material, i.e., one load or batch of the drum. According to the invention, it has been found that the drum can be loaded with one batch of asphaltic concrete, heated to a desired temperature, with port 14 closed, and thereafter, recovery and filling can be carried out on a continuous process, with composition being fully heated and mixed. In other words, once the desired temperature of the initial batch of composition is achieved, thereafter, as composition is introduced into the port 12, just beyond the port lip as it falls therein gravitationally from the chute, the composition is then continuously mixed and gradually drawn from the open port 12 to rear port 14, during which time it becomes fully heated and mixed. Thus, the composition being recovered through port 14 during such continuous processing has been gradually drawn from the forward drum end to the rear, while it is being continually mixed and heated. Because of the position at which the chute introduces composition into the drum, just past or inside open port 12, such an apparatus is advantageous as compared to the usual shoveling of material into the drum, which often directs it into the drum quite beyond the port 12. Such a fact will be appreciated, again considering that without the chute, the operator introduces composition by throwing shovelfulls into the drum port, which force directs the material particles well past the port, often deep into the drum interior, so that the distance along the drum length remaining between where the composition falls, and rear drum port 14, is not sufficient for adequate heating of the material in a continuous process. However, with a chute of the invention, automatic proper selection of the position at which the composition is introduced for suitable continuous processing is achieved.

Because of the aforesaid advantages of processing materials utilizing the improved apparatus of the invention, additional apparatus advantages may be achieved. Prior to the addition of the chute, continuous processing utilizing the apparatus disclosed in my aforesaid co-pending applications was understood to be most efficient by incorporating a hopper feed means at the end of the rotating drum, opposite the open port. The preferred hopper included a screw feed for controlling suitable feed rates of particles to the drum, but was limited in that the recycle material must be crushed and sized, because the hopper and screw feed will not handle larger particles, for example those which will not pass a 4" mesh sieve. Yet, when old asphaltic concrete is being taken up, particularly at a job site where it is to be also recycled and laid back down, as previously noted, unless this composition is crushed and sized, a range of particle sizes will be encountered, a significant amount of the composition being greater than that which the hopper and screw feed could handle. Some chunk sizes encountered often are 6" or more in nominal diameter. Although such larger chunks of material may be placed in the open port of the drum and processed, that would require the drum to be fed from both ends at the same time, which obviously is unsuitable for continuous process recovery operations. Accordingly, the use of the chute of the present invention provides for continuous feeding of such recycle compositions having the great variety of particle sizes, all of which can be introduced into the drum in the chute at the forward drum port, and processed in a continuous manner and recovered. Thus, with such an apparatus modification of the invention, the hopper feed means previously described, may be even omitted with no substantial change in continuous processing advantages, thereby substantially reducing the cost factors of the appratus. An additional advantage of the chute is found for deflecting exhaust gases from the drum interior during processing upwardly, out of the way of operator. These as well as other advantages will be evident to those skilled in the art.

I claim:

1. A continuous process for recycling asphaltic concrete composition comprising recovering said composition from a paved surface to form a material including asphaltic concrete particles which will not pass a 4" sieve, feeding said composition onto a chute and gravitationally introducing said composition from said chute into a drum having an open port at one end and a closed recovery port adjacent the opposite drum end, introducing hot gases of combustion into said open port while rotating the drum until the composition therein is at a temperature of at least 225° F., opening said recovery port and continuously recovering composition therefrom while simultaneously continuously feeding a like amount of composition onto said chute.

2. The process of claim 1 wherein said composition feed rate and recovery rate is such that recovered composition has a temperature of at least about 225° F.

3. The process of claims 1 or 2 wherein exhaust gases from said drum are vented substantially only through said open port concurrently as said hot gases of combustion are directed therein and while said recovery port is closed.

* * * * *